US005490640A

United States Patent [19]

Miller et al.

[11] Patent Number: 5,490,640

[45] Date of Patent: Feb. 13, 1996

[54] TORQUE-ACTUATED EXPANSIBLE SHAFT ASSEMBLY FOR ROLL CORE

[75] Inventors: William R. Miller, Portland, Oreg.; Timothy J. Becker, Vancouver, Wash.; John E. Olson, Portland, Oreg.

[73] Assignee: Tidland Corporation, Camas, Wash.

[21] Appl. No.: 288,946

[22] Filed: Aug. 10, 1994

[51] Int. Cl.[6] ..... B65H 75/24

[52] U.S. Cl. ..... 242/571.6; 242/575.3; 242/575.4; 279/2.2; 279/2.24

[58] Field of Search ..... 242/571.6, 575.3, 242/575.4, 575.5; 279/2.19, 2.2, 2.24

[56] References Cited

U.S. PATENT DOCUMENTS

| | | | |
|---|---|---|---|
| 1,188,369 | 6/1916 | Chernack | 242/571.6 X |
| 2,196,489 | 4/1940 | Bennett | 279/2.19 X |
| 2,468,867 | 5/1949 | Collins | 279/2.19 X |
| 2,528,873 | 11/1950 | Dorman . | |
| 2,558,689 | 6/1951 | Miller | 242/575.3 |
| 2,561,745 | 7/1951 | Lerch . | |
| 2,573,327 | 10/1951 | Gossard | 279/2.19 X |
| 3,001,736 | 9/1961 | Schultz et al. . | |
| 3,018,977 | 1/1962 | Skallquist . | |
| 3,146,964 | 9/1964 | Schultz et al. . | |
| 3,281,092 | 10/1966 | Schultz et al. . | |
| 3,332,694 | 7/1967 | Price . | |
| 3,387,799 | 6/1968 | Wilson | 242/571.6 |
| 3,623,741 | 11/1971 | Reeder, Jr. et al. . | |
| 3,774,921 | 11/1973 | Gifford . | |
| 3,792,868 | 2/1974 | Flagg . | |
| 3,910,520 | 10/1975 | Mosser | 242/571.6 |
| 3,963,250 | 6/1976 | Flagg . | |
| 3,993,317 | 11/1976 | Flagg . | |
| 4,147,312 | 4/1979 | Secor et al. . | |
| 4,193,633 | 3/1980 | Potter . | |
| 4,334,652 | 6/1982 | Blackburn . | |
| 4,519,620 | 5/1985 | Keith . | |
| 4,771,963 | 9/1988 | Gattrugeri . | |

FOREIGN PATENT DOCUMENTS

| | | | |
|---|---|---|---|
| 105700 | 4/1917 | United Kingdom | 279/2.2 |

OTHER PUBLICATIONS

Rasmussen, A. C., "Internal Friction Blocks and Shoes," Nov. 1, 1946.

Shigley, Joseph E. and Charles Mischke, "Torque and Force Analysis of Rim Clutches and Brakes," *Standard Handbook of Machine Design,* 1986, pp. 30.24–30.34.

*Primary Examiner*—John M. Jillions

*Attorney, Agent, or Firm*—Chernoff, Vilhauer, McClung & Stenzel

[57] ABSTRACT

An expansible shaft assembly has core-engagement shoes pivotally mounted to a shaft for pivoting outwardly into tight engagement with the interior of a roll core automatically in response to the application of torque to the shaft. The core-engagement shoes have core-engaging surfaces, some being pivotable outwardly in response to torque applied to the shaft in one axial direction and others being pivotable outwardly in response to torque applied in the opposite axial direction. The respective oppositely-actuated core-engaging surfaces can both be on the same engagement shoe or, alternatively, on different shoes spaced axially along the shaft. For maximizing the speed with which the core-engagement shoes engage the core in response to torque application, the core-engaging surfaces are preferably angularly offset significantly from a radial direction extending between the axis of rotation of the shaft and the pivot axis of the engagement shoe.

16 Claims, 9 Drawing Sheets

TORQUE-ACTUATED EXPANSIBLE SHAFT ASSEMBLY FOR ROLL CORE

BACKGROUND OF THE INVENTION

This invention relates to a torque-actuated expansible shaft assembly for insertion into a paper roll core or other sheet roll core. The shaft assembly may constitute either a relatively short chuck for insertion into the end of a core, or a much longer shaft assembly extending completely through the core from end-to-end.

During manufacture of paper or other sheet products, the sheet material is typically wound onto, or unwound from, a tubular core supported by a diametrically-expansible shaft assembly insertable into the core and selectively actuated so as to expand into engagement with the core for transmitting either driving torque or braking torque to the core. Most conventional expansible roll core shaft assemblies employ core-engaging elements actuated either by means of pneumatically-expandable elements or by means of internal torque-actuated cams. Examples of pneumatically-actuated shaft assemblies are shown in U.S. Pat. Nos. 4,147,312 and 4,771,963. Examples of torque-actuated-cam shaft assemblies are shown in U.S. Pat. Nos. 2,528,873, 2,561,745, 3,332,694, 3,623,741, 3,774,921, 3,792,868, 3,963,250, 3,993,317, 4,193,633, 4,334,652, and 4,519,620. All of these shaft assemblies require complex internal structures for actuating the core-engaging elements to cause them to expand into engagement with the core, such structures being relatively expensive to fabricate, in need of frequent servicing, and highly susceptible to wear. Moreover, the cam-actuated shaft assemblies can develop significant friction at their camming surfaces which, if the actuating torque is high, can lock the cams making it difficult to disengage the shaft assembly from a core.

Other types of previous core-engaging shaft assemblies include those employing rocker-type lugs pivotally mounted on a shaft for pivoting outwardly into engagement with the interior of a core in response to the application of torque to the shaft. Examples of these shaft assemblies are shown in U.S. Pat. Nos. 3,001,736, 3,018,977, 3,146,964, and 3,281,092. These shaft assemblies do not need cams, because their lugs are actuated in response to torque applied through the shaft directly to the pivot axes of the lugs rather than through cam surfaces, and therefore do not suffer from the same frictional disadvantages and complexities of torque-actuated-cam assemblies. However, these latter shaft assemblies do suffer from a major disadvantage in that they are incapable of being actuated bidirectionally automatically in response to reversals of torque while remaining inserted in the core. Some of these assemblies, such as that shown in U.S. Pat. No. 3,281,092, can be adapted to apply torque to the core in a reverse direction but only by withdrawing the shaft assembly from the core and reconfiguring it mechanically. Others, such as that shown in U.S. Pat. No. 3,018,977, can apply torque to the core bidirectionally because they are locked in an engagement position, but such locking prevents them from being actuated bidirectionally in response to reversals of torque, which in turn prevents them from releasing from the core automatically in response to the absence of such torque to enable their quick removal from the core. Moreover, the torque-actuated lugs of these shaft assemblies require a relatively large angular pivoting motion to accomplish core engagement in response to applied torque, which can make the core engagement too slow. In addition, the continuous extension of the lugs axially along the shaft assembly significantly impairs the beam strength of the assembly.

SUMMARY OF THE INVENTION

The present invention provides a unique expansible shaft construction employing a plurality of core-engagement shoes pivotally connected to a shaft so as to pivot about respective axes extending parallel to the axis of rotation of the shaft and spaced therefrom, each shoe having at least one outwardly-facing core-engaging surface thereon.

According to one aspect of the invention, some of the core-engaging surfaces are pivotable outwardly in response to torque applied to the shaft assembly in one axial direction while, at the same time others are pivotable outwardly in response to torque applied to the shaft assembly in the opposite axial direction. This feature provides instantaneous torque-actuation of the core-engagement shoes in response to a transition between driving and braking torque applied to the shaft assembly.

According to a separate aspect of the invention, the core-engagement shoes are pivotable outwardly in response to torque applied to the shaft upon which they are pivotally mounted so that the torque is applied directly through their pivot axes, and they are pivotable inwardly to disengage the core in response to the absence of such torque. Each core-engaging surface is positioned along a respective lever-arm direction, extending from the respective pivot axis of the shoe, having an angular separation of at least 70° from a radial pivot-axis direction extending between the axis of rotation of the shaft and the pivot axis of the shoe, so as to provide exceptionally quick torque-actuated engagement.

According to another separate aspect of the invention, bidirectional torque-actuated engagement by the pivoted engagement shoes is accomplished by providing each shoe with a pair of outwardly-facing core-engaging surfaces located on opposite sides of the respective pivot-axis direction which extends radially between its pivot axis and the axis of rotation of the shaft.

According to another separate aspect of the invention, bidirectional torque-actuated engagement by the pivoted engagement shoes is accomplished compatibly with the maintenance of high beam strength of the shaft assembly by arranging the core-engagement shoes in respective different groups spaced axially along the shaft, some of the groups being outwardly pivotable in response to torque applied to the shaft assembly in one axial direction, and the other groups being outwardly pivotable in response to torque applied in the opposite axial direction.

Another separate aspect of the invention likewise contributes to beam strength by providing a shaft which comprises a tubular member surrounding the respective pivot axes in fixed relation thereto, and having a tubular wall defining separate apertures formed therein, with each pivotable core-engaging surface protruding outwardly through a respective one of the apertures.

Another separate aspect of the invention provides core-engagement shoes arranged in respective different groups, each group having its respective core-engaging surfaces located at different distances from their respective pivot axes and being interchangeably connectable pivotally to the same shaft, thereby rendering the shaft readily adaptable to engage cores of different inside diameters.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
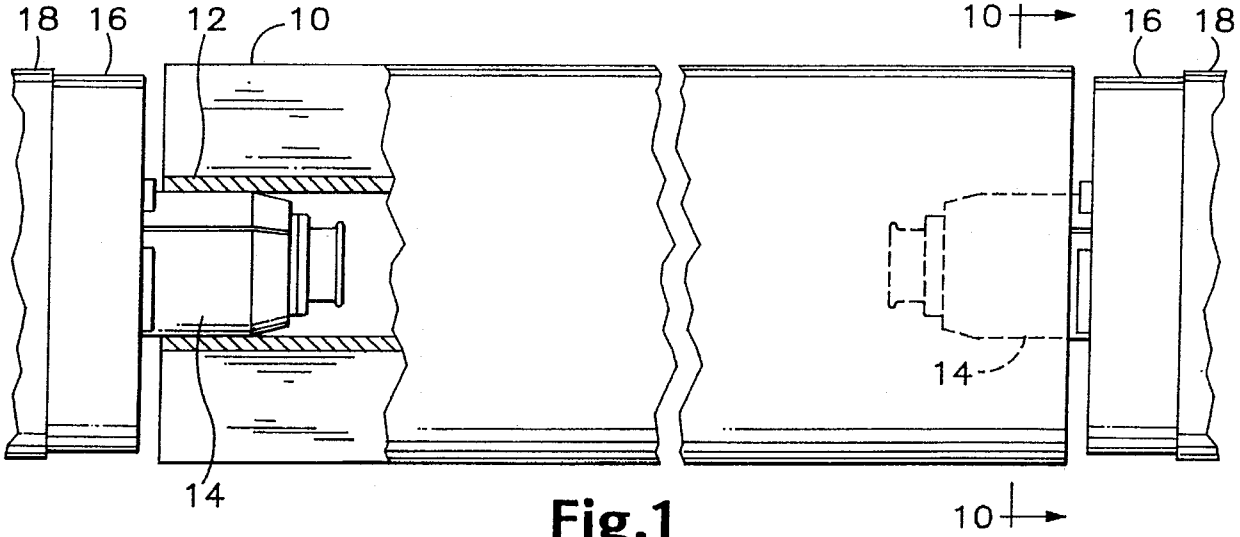
FIG. 1 is a partially sectional, extended side view of a first exemplary embodiment in accordance with the present invention, showing two shaft assemblies supporting the ends of a roll core.
Figure 2:
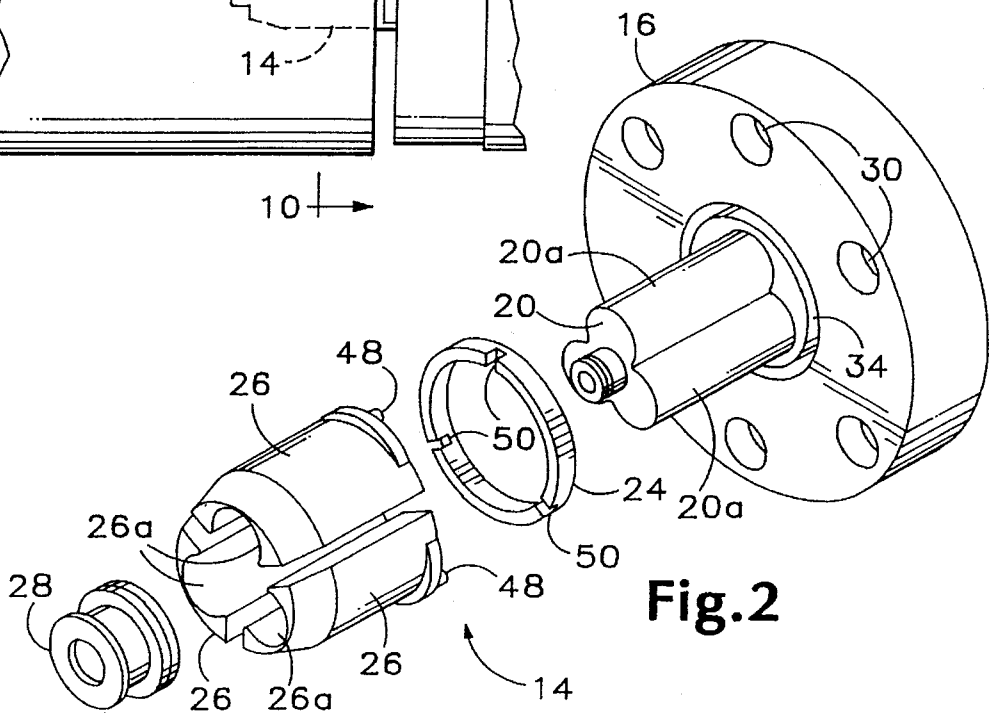
FIG. 2 is an exploded perspective view of one of the shaft assemblies of FIG. 1.

FIG. 1 depicts a roll 10 of paper or other sheet material wound on a roll core 12 between a pair of shaft assemblies 14 constructed in accordance with a first exemplary embodiment of the present invention. Each shaft assembly 14 has a base flange 16 by which it is bolted to a respective hub 18 of a conventional machine capable of applying torque to the shaft assemblies. Preferably the machine can apply either driving torque or braking torque selectively to the shaft assemblies 14 through the hubs 18. However, the shaft assemblies of the present invention can be employed with machines capable of applying only torque in one direction.

Figure 6:
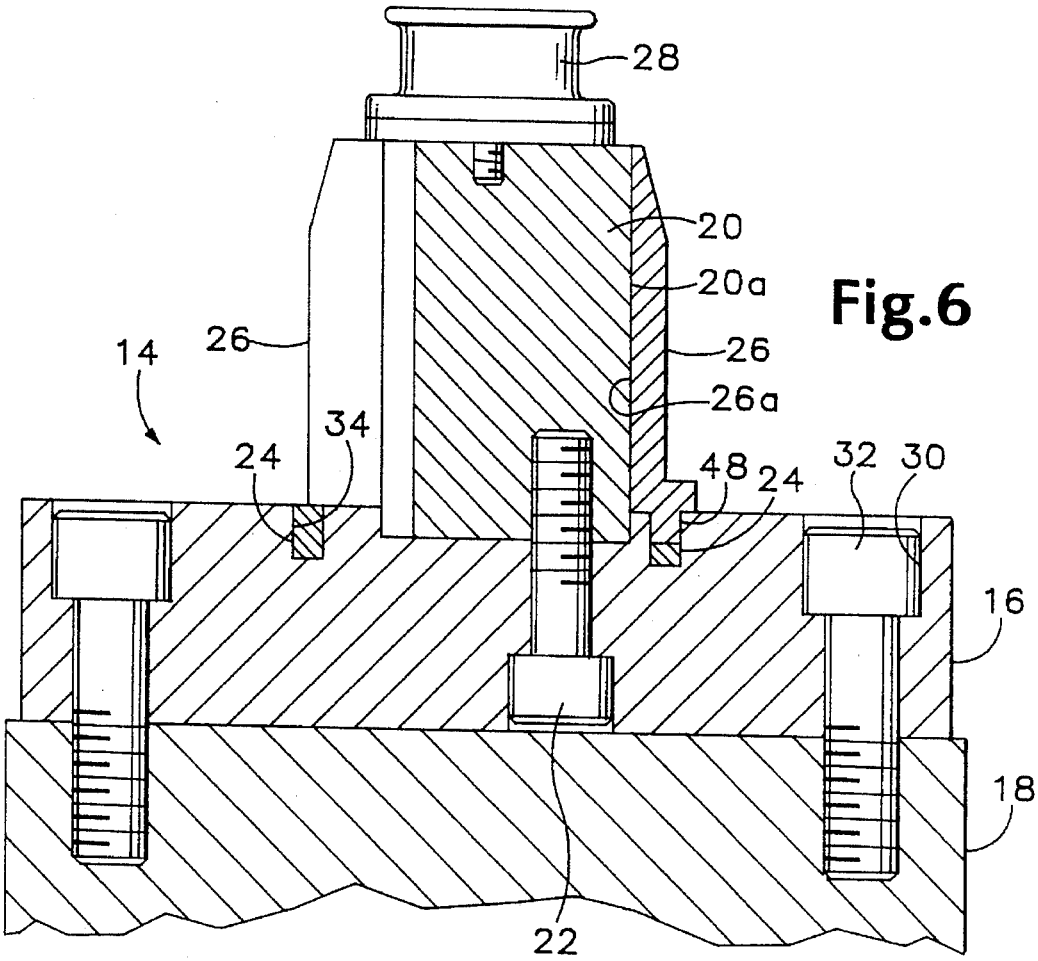
FIG. 6 is a sectional view taken along line 6—6 of FIG. 5.
Figure 7:
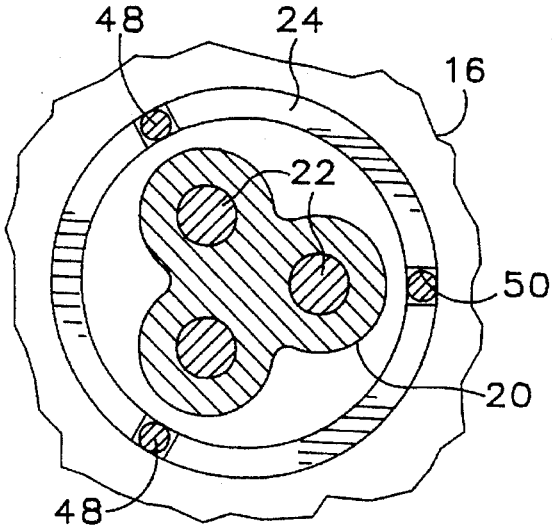
FIG. 7 is a detail sectional view taken along line 7—7 of FIG. 4
Figure 8:
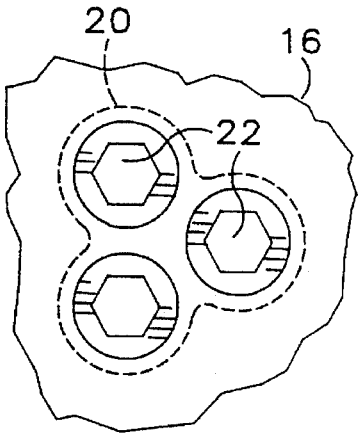
FIG. 8 is a detail view taken along line 8—8 of FIG. 4.

Each shaft assembly 14 has a shaft 20 bolted to the base flange 16 by bolts 22 as shown in FIGS. 6–8, a synchronizing ring 24, three core-engagement shoes 26, and a quick-disconnect cap 28. The base flange 16 has peripheral holes 30 for accommodating bolts 32 to mount the flange 16 rigidly to the machine hub 18. Formed in the face of the flange 16 is a central depression for matingly accepting the insertion of one end of the shaft 20 where it is affixed by the bolts 22. Surrounding the bolted end of the shaft 20 is an annular groove 34 for slidably accepting the synchronizing ring 24 so that it may rotate freely within the groove 34. Each of the core-engagement shoes 26 has a cylindrical inner surface 26*a* for pivotally engaging a respective one of three cylindrical journal surfaces 20*a* on the shaft 20. Each inner surface 26*a* extends through an arc of more than 180° so that each shoe 26 can become detached from the shaft 20 only by sliding the respective shoe axially off the end of the shaft. Each core-engagement shoe 26 has a respective synchronizing stud 48 depending from its base. Each synchronizing stud 48 fits matingly within a respective notch 50 of the synchronizing ring 24 so that all of the core-engagement shoes 26 must pivot uniformly and in unison with respect to the shaft 20.

Figure 9:
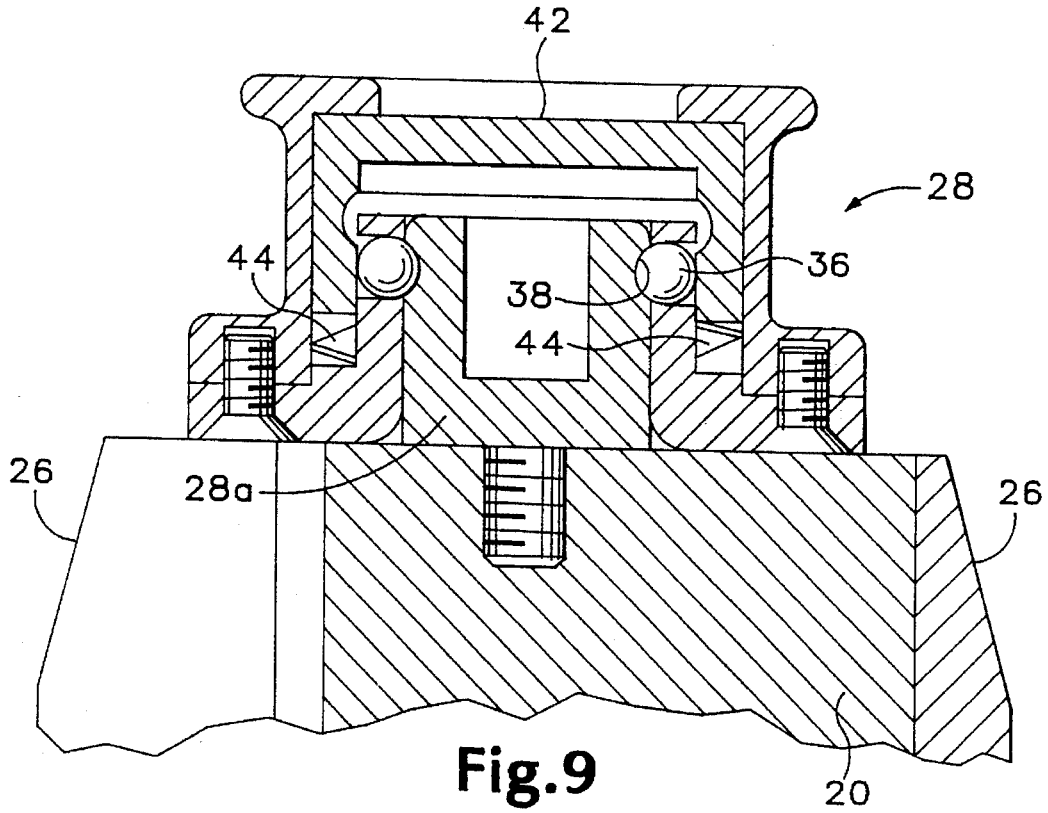
FIG. 9 is an enlarged cross-sectional view taken along line 9—9 of FIG. 4.
Figure 9A:
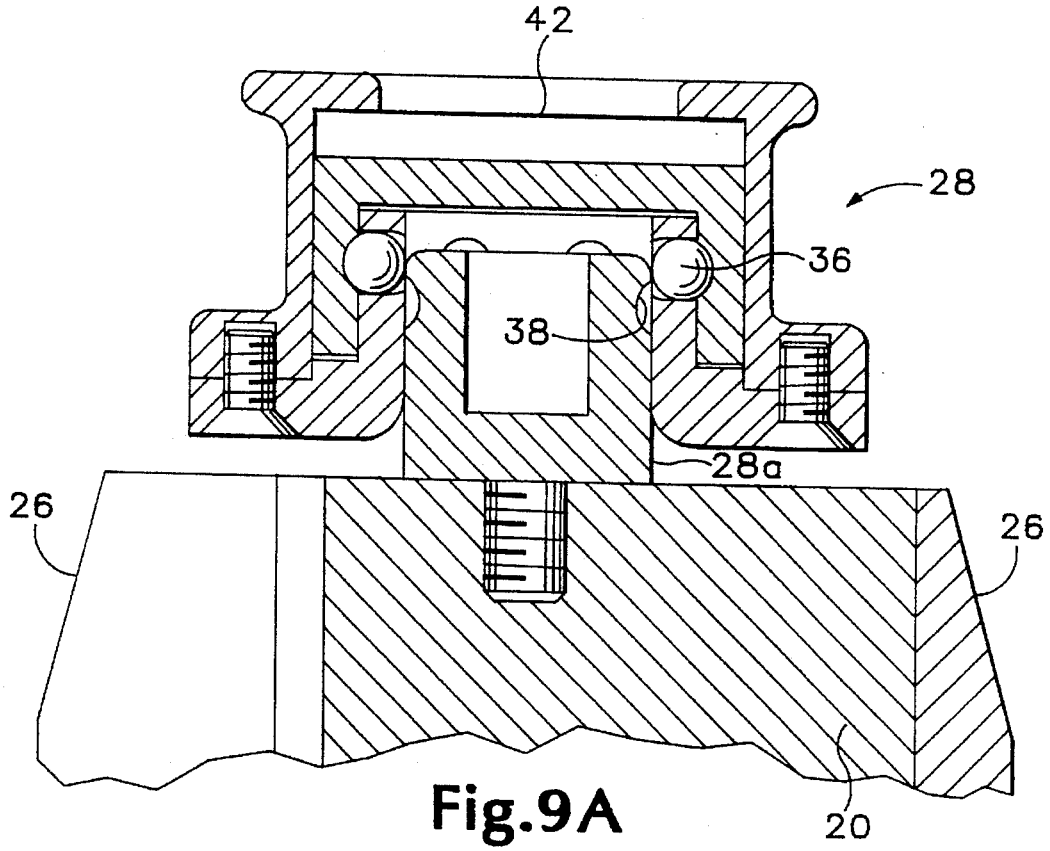
FIG. 9A is a cross-sectional view similar to that of FIG. 9 shown in a moved position.

The quick-disconnect cap 28 (FIGS. 9 and 9A) prevents the shoes 26 from sliding off the end of the shaft 20 under normal operating conditions by virtue of its detachable connection to a stud 28*a* bolted to the end of the shaft 20. The quick-disconnect cap engages the stud in a conventional manner by normally retaining a plurality of ball bearings 36 in engagement with a peripheral groove 38 formed in the surface of the stud 28*a*. When it is desired to remove the shoes 26 from the shaft 20, the central portion 42 of the cap 28 is depressed against the biasing pressure of a peripheral wave spring 44 to permit the retraction of the ball bearings 36 from the groove 38, thereby permitting the cap 28 to be removed from the stud 28*a*.

Figure 10:
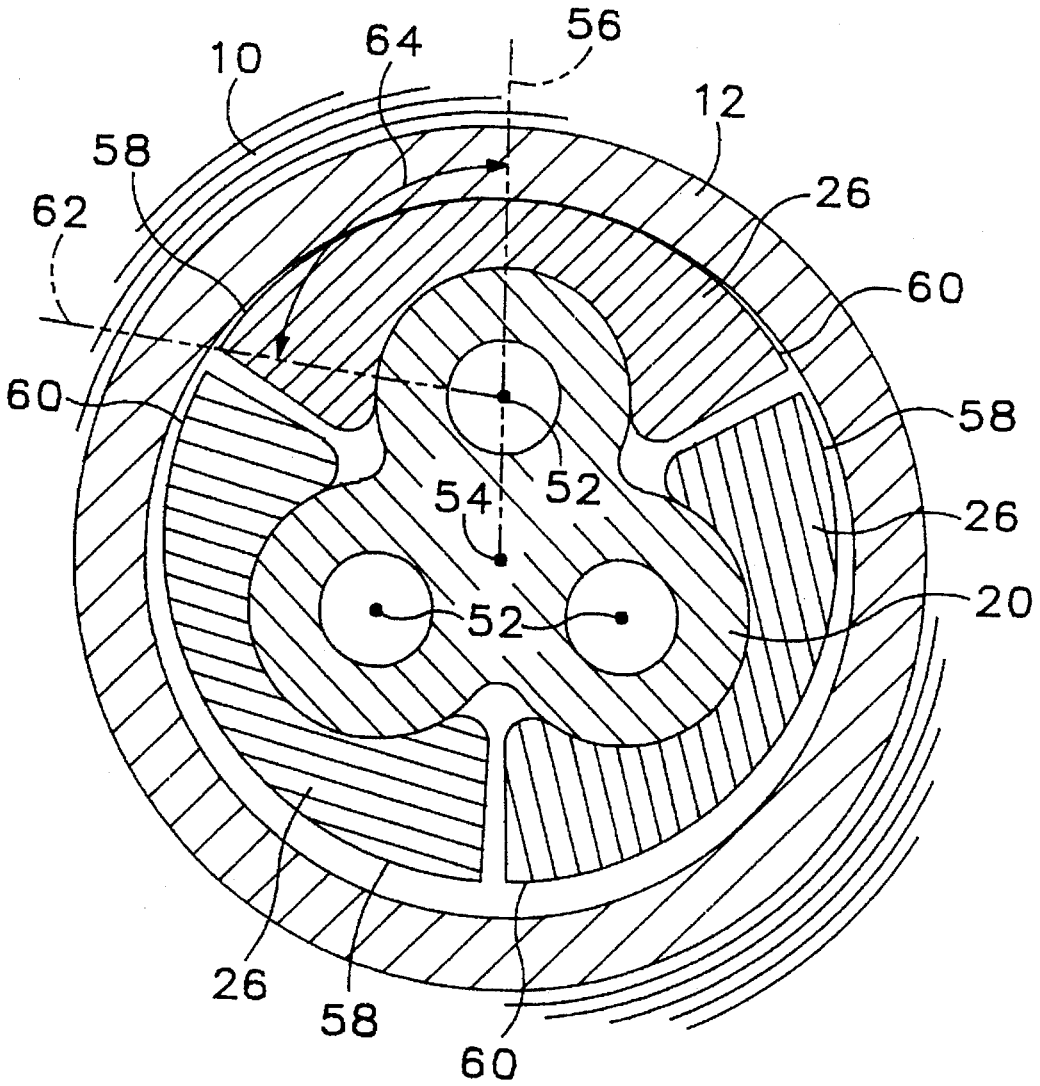
FIG. 10 is a sectional view taken along line 10—10 of FIG. 1.

With reference to FIG. 10, in operation the shaft 20 and its core-engagement shoes 26 are inserted into the end of a roll core 12, the shoes 26 having been dimensioned so as to fit loosely within the core 12 (although the looseness depicted in FIG. 10 is somewhat exaggerated for purposes of illustration). Each shoe 26 is pivotable about a respective pivot axis 52 extending parallel to the axis of rotation 54 of the shaft 20, and spaced radially therefrom. Each pivot axis is located along a respective pivot-axis direction such as 56 extending radially from the axis of rotation 54 of the shaft 20. To enable the shaft assembly to be bidirectionally torque-actuated into tight engagement with the core 12, each shoe 26 has a pair of outwardly-facing core-engaging surfaces 58 and 60, respectively, located on opposite sides of its pivot-axis direction 56. Each core-engaging surface 58, 60 is preferably positioned along a respective lever-arm direction 62 having an outwardly-facing angular separation 64 from the pivot axis direction 56 of at least 70° and, more preferably, at least 80°.

Figure 10A:
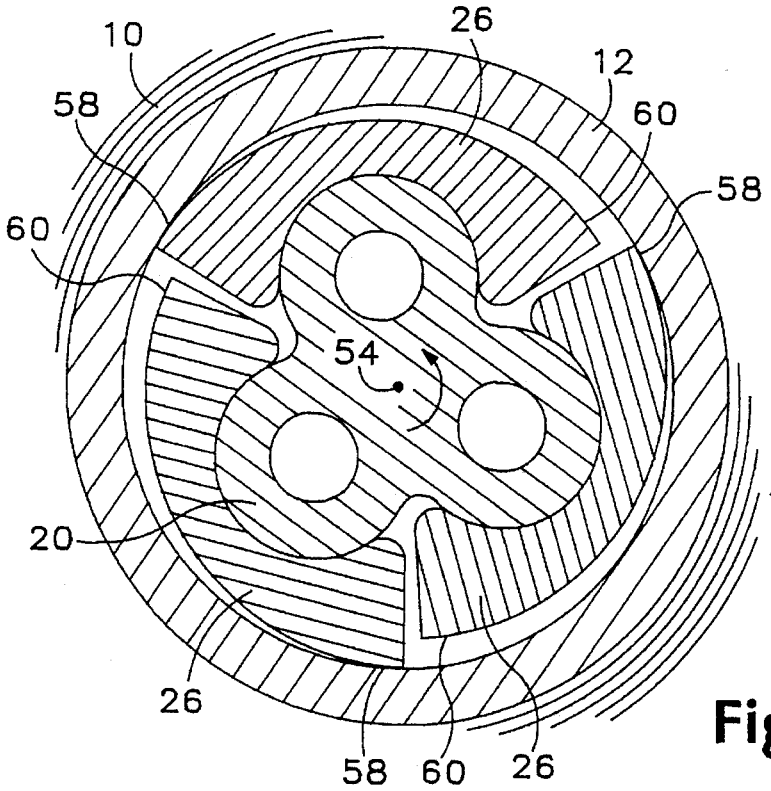
FIG. 10A is a cross-sectional view similar to that of FIG. 10 but showing the shaft assembly with its core-engagement shoes actuated in response to the application of torque in one axial direction.
Figure 10B:
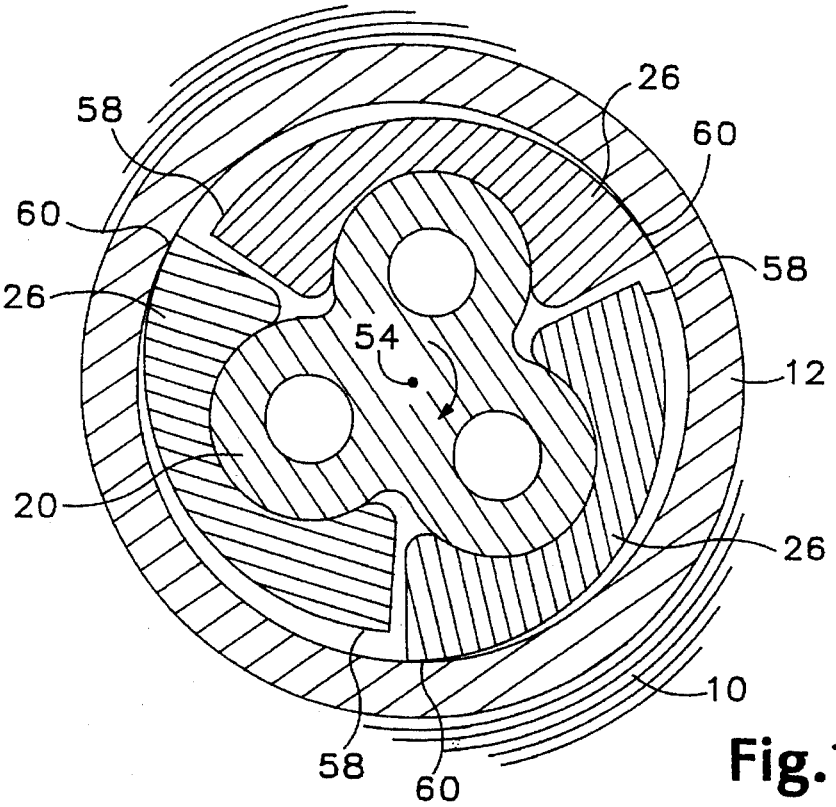
FIG. 10B is a cross-sectional view similar to that of FIG. 10A but showing the core-engagement shoes actuated in response to torque applied in the opposite axial direction.

With the roll core 12 resting atop the shaft assembly as shown in FIG. 10, either driving or braking torque is applied to the shaft assembly through the base flange 16 to actuate the core-engagement shoes 26 into tight engagement with the interior of the core 12. As depicted in FIG. 10A, counterclockwise torque applied to the shaft 20 forces pivoting of the upper engagement shoe 26 in a clockwise direction relative to its respective pivot axis due to its frictional engagement with the interior of the core 12, which resists such torque application due to the inertia of the roll 10. The interconnection of the synchronizing ring 24 through the synchronizing studs 48 with each of the engagement shoes 26 thus causes all of the engagement shoes to pivot clockwise in unison about their respective pivot axes so that all three of the core-engaging surfaces 58 of the three shoes 26 pivot outwardly to engage the interior of the core 12 uniformly. This torque-actuated engagement centers the core 12 concentrically relative to the axis of rotation 54 of the shaft 20 as shown in FIG. 10A so that the roll 10 is dynamically balanced on the shaft. Removal of the torque applied to the shaft 20 will enable the core-engaging surfaces 58 to pivot inwardly about their respective pivot axes back to their positions as shown in FIG. 10, thereby permitting ready disengagement of the shaft assembly from the core 12. Conversely, the application of torque to the shaft 20 in the opposite axial direction as shown in FIG. 10B results in counter-clockwise pivoting of the core-engagement shoes 26 about their respective pivot axes so that the core-engaging surfaces 60 located on the opposite sides of the respective pivot-axis directions 56 pivot outwardly to engage the interior of the core 12, in a configuration which is the mirror image of that shown in FIG. 10A. Thus, the illustrated arrangement provides instantaneous torque-actuated engagement in response to either of two opposite torque applications to accommodate transitions between driving torque and braking torque without requiring any removal of the shaft assembly from the core, while at the same time providing automatic core disengagement in response to the absence of applied torque.

If only unidirectional torque-responsive actuation is needed in a particular application, it is within the scope of the present invention to construct the engagement shoes 26 without a pair of core-engaging surfaces 58 and 60, but rather with only one of such core-engaging surfaces. However, by constructing the shoes with a pair of core-engaging surfaces, the shaft assembly is more versatile since it can be used for either unidirectional or bidirectional torque-actuated engagement.

Figure 3:
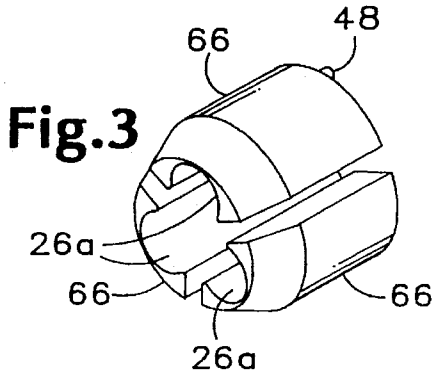
FIG. 3 is an exploded view of a group of core-engagement shoes interchangeable with those of FIG. 2 but of larger diameter.
Figure 4:
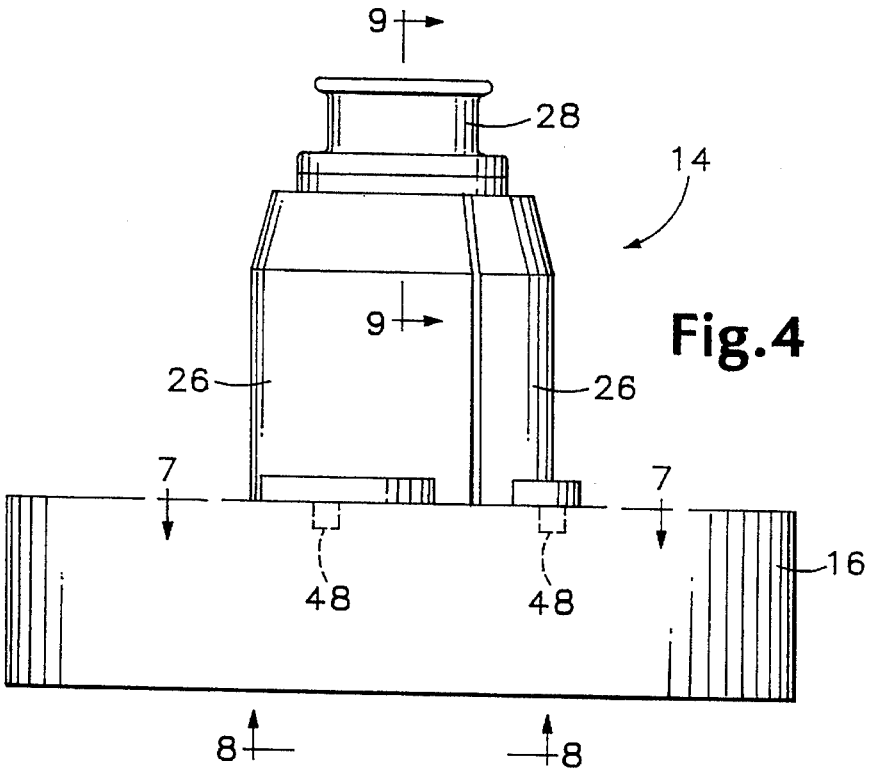
FIG. 4 is an enlarged side view of the shaft assembly of FIG. 2.
Figure 5:
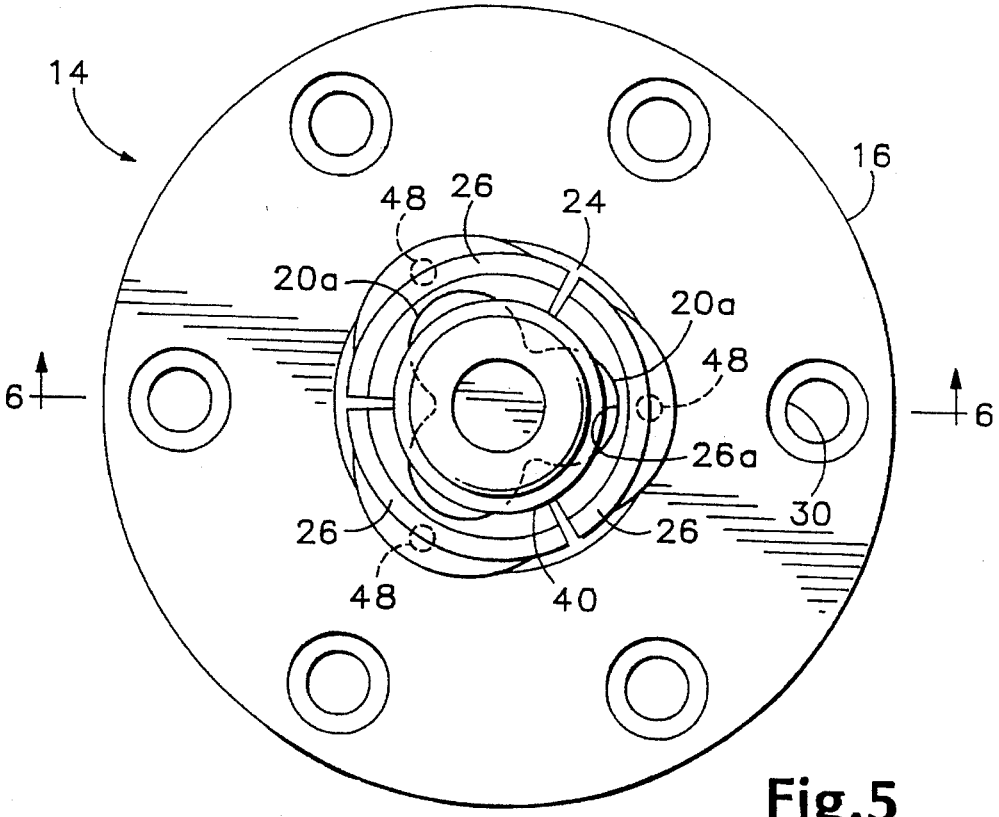
FIG. 5 is a top view of the shaft assembly of FIG. 4.

If a core 12 having either a smaller or a larger inside diameter is to be engaged by the shaft assembly 14, the quick-disconnect cap 28 can be detached and the shoes 26 can be slid axially off of the shaft and replaced interchangeably with another group of shoes 66 (FIG. 3) having its respective core-engaging surfaces separated from its respective pivot axes by greater (as shown) or lesser distances than the core-engaging surfaces 58, 60 of the shoes 26. Either an enlargement or a reduction in size of the shaft assembly 14 to accommodate different-sized cores 12 is thereby possible.

Figure 11:
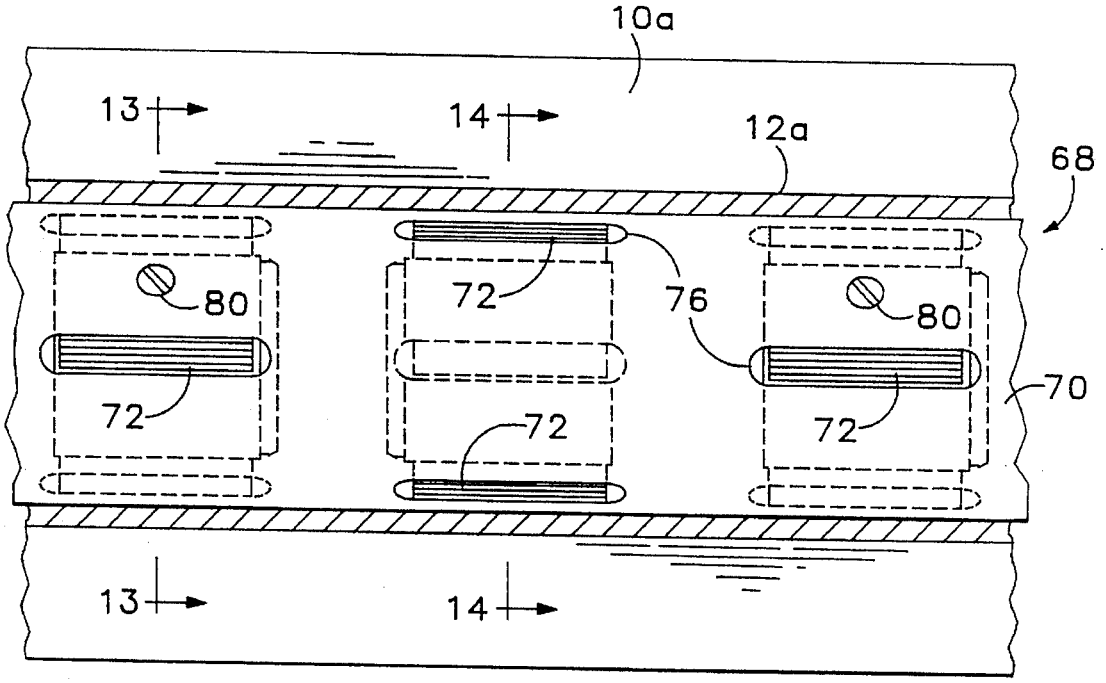
FIG. 11 is a partially sectional side view of a second exemplary embodiment of a shaft assembly in accordance with the present invention.
Figure 12:
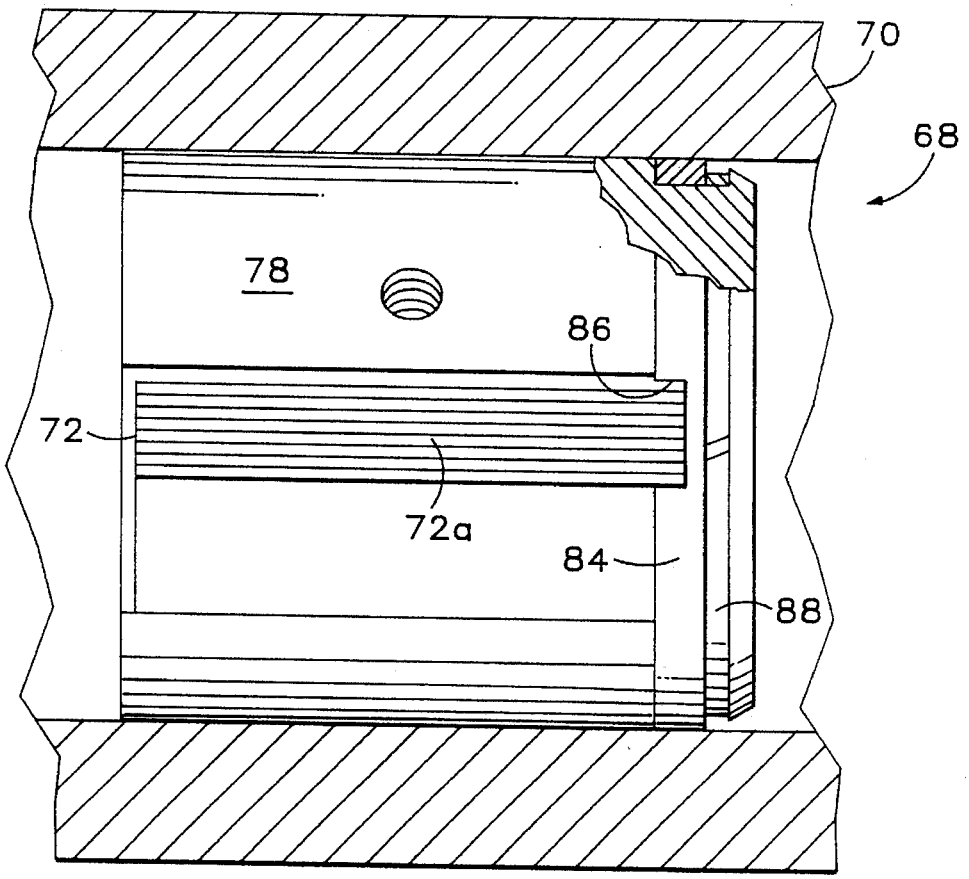
FIG. 12 is a partially sectional enlarged side view of a portion of the shaft assembly of FIG. 11.

FIGS. 11–14A illustrate a second exemplary embodiment of a shaft assembly in accordance with the present invention, intended for applications where a greater degree of beam strength of the shaft assembly is required. This embodiment is applicable particularly to long shaft assemblies which extend from end-to-end of a core, as opposed to short shaft assemblies or chucks as shown in the previous embodiment which support merely the ends of a core. The long shaft assembly 68 shown in FIGS. 11–14A comprises an elongate tubular shaft 70 inserted within a core 12*a* which supports a roll 10*a*. The ends of the shaft 70 are connected to respective base flanges (not shown) similar to flanges 16 for mounting on machine hubs such as 18. Unlike the previous embodiment, however, the core-engagement shoes 72 are largely enclosed by the tubular structure of the shaft 70, and arranged in discontinuous groups of shoes 72 spaced axially along the shaft 70 as shown in FIG. 11 with the core-engaging surfaces 72*a* of the respective shoes protruding outwardly through respective axially-spaced apertures 76 in the tubular wall of the shaft 70. The respective groups of engagement shoes 72 are each pivotally mounted to respective pivot support structures 78 inserted into the shaft 70 and fixed thereto by screws 80. During assembly, each pivot support structure 78 is slid axially through the interior of the shaft 70 with its respective shoes 72 aligned through the apertures 76 with the respective pivot axes 82 of the respective support structure 78, so that each pivot support structure slides axially over the pivoted ends of its shoes. Thereafter the screws 80 are inserted to fix the pivot support structure 78 to the shaft 70. Each pivot support structure 78 includes a rotatable synchronizing ring 84 (FIG. 12) at one end with notches 86 for engaging the edges of the respective shoes 72 and causing them to pivot in unison similarly to the function of the synchronizing ring 50 described previously. A snap ring 88 fastens the synchronizing ring 84 rotatably to the pivot support structure 78. As in the previous embodiment, shoes 72 of different sizes can be interchangeably connected pivotally to the pivot support structure 78 to accommodate cores 12*a* of different inside diameters. Also, as in the previous embodiment, the angular separation 88 (FIG. 13) between the pivot-axis direction 90 and the lever-arm direction 92 should preferably be at least 70°, and more preferably at least 80°.

Figure 13:
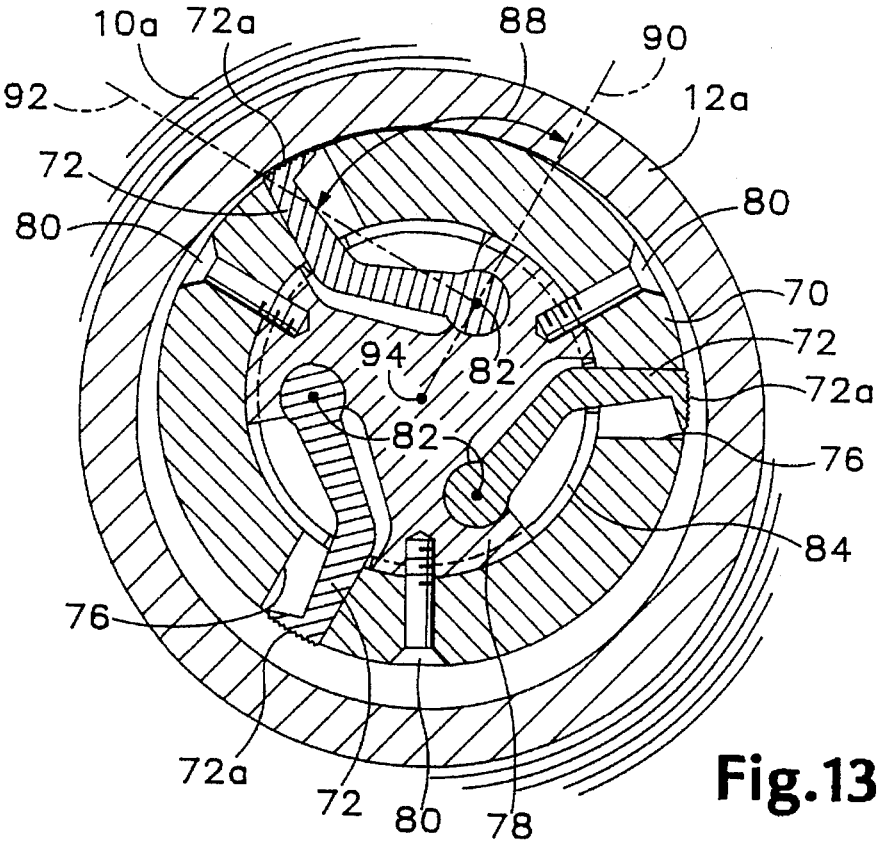
FIG. 13 is an enlarged cross-sectional view taken along line 13—13 of FIG. 11.
Figure 13A:
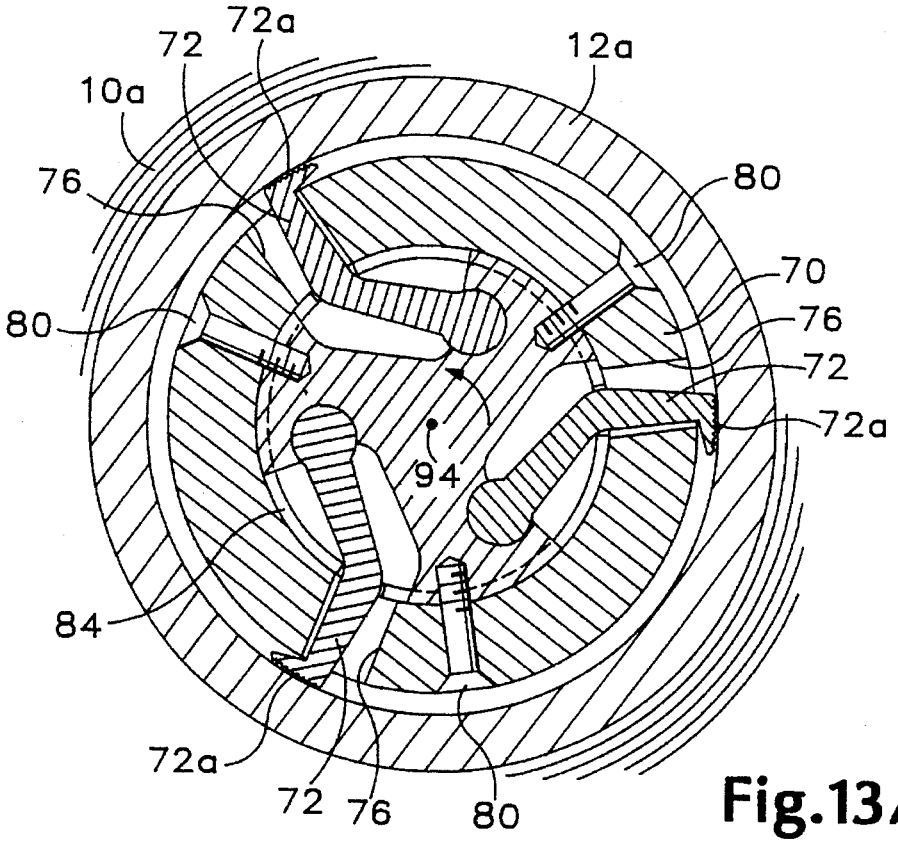
FIG. 13A is a cross-sectional view similar to that of FIG. 13 but showing the core-engagement shoes actuated in response to the application of torque in one axial direction.
Figure 14:
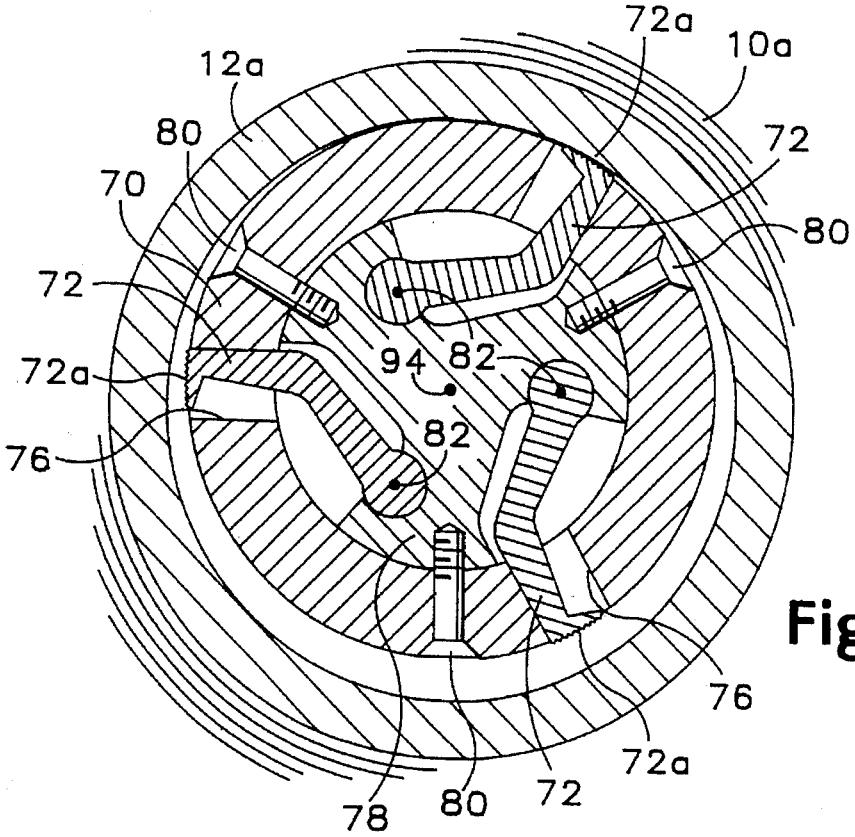
FIG. 14 is an enlarged cross-sectional view taken along line 14—14 of FIG. 11.
Figure 14A:
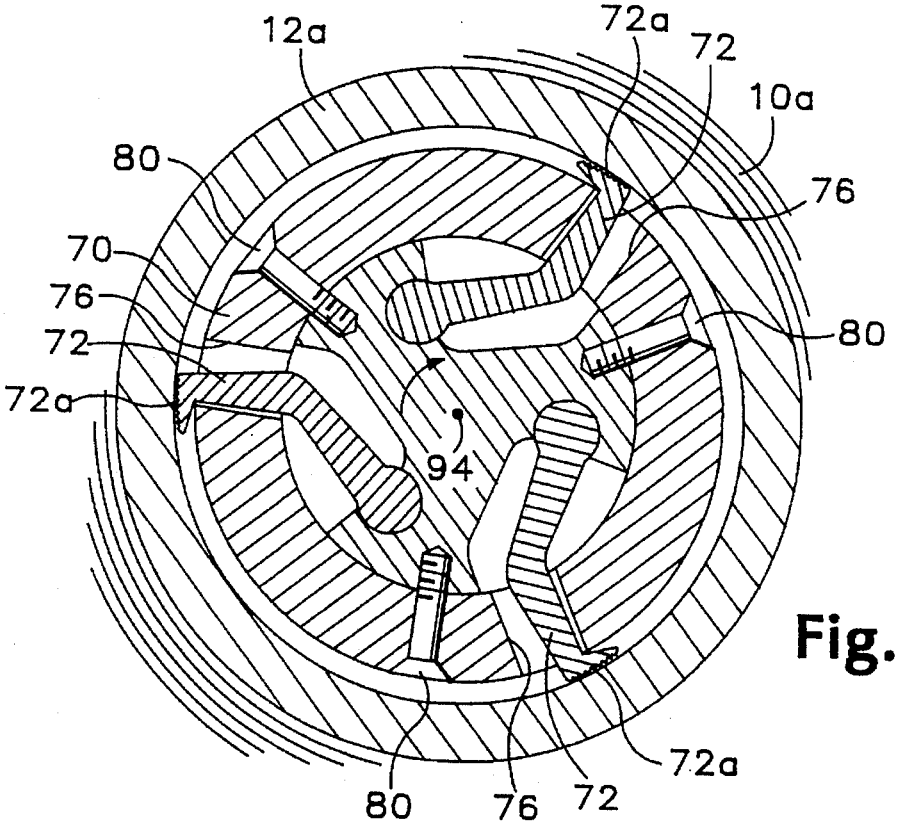
FIG. 14A is a cross-sectional view similar to that of FIG. 14 but showing the core-engagement shoes actuated in response to torque applied in the axial direction opposite to that shown in FIG. 13A.

In operation, the shaft 70 is inserted loosely within the core 12*a* as shown in FIG. 13. As shown in FIG. 13A, counterclockwise torque applied to the shaft 70 pivots the core-engaging surfaces 72*a* of the shoes 72 outwardly into tight engagement with the core, thereby centering the core concentrically with respect to the axis of rotation 94 of the shaft 70. Since the shoes 72 of FIG. 13, however, do not have pairs of core-engaging surfaces located on opposite sides of their respective pivot-axis directions 90, they are pivotally engageable with the core only in response to counterclockwise torque application as shown in FIG. 13A. If only unidirectional torque-actuated engagement is needed, then all of the axially-spaced groups of engagement shoes can be oriented in the same axial direction within the tubular shaft 70. However, if bidirectional torque-actuated engagement is needed, then alternate groups of the core-engagement shoes 72 and their pivot support structures 78 are oriented in opposite axial directions as shown in FIG. 11, so that alternate groups have a cross-section as shown in FIG. 14 which is a mirror image of that shown in FIG. 13. Thus, the shoes 72 of FIG. 14 pivot outwardly into engagement with the core in response to the application of torque to the shaft as shown in FIG. 14A, i.e., in the opposite direction from that shown in FIG. 13A. The shaft assembly 68 can thereby perform the same bidirectional torque-actuated core-engagement and core-disengagement functions as described with respect to the previous embodiment.

In both of the exemplary embodiments described herein, the application of torque to pivot the engagement shoes outwardly is by means of torque applied through the shaft directly to the respective pivot axes of the respective engagement shoes. Although cam actuation of pivoted engagement shoes, as shown for example in U.S. Pat. No. 2,528,873 (hereby incorporated by reference), can alternatively be employed within the scope of the present invention, it is inferior to the pivot-axis actuation disclosed herein because of the cams' complexity and friction which can result in inadvertent locking of the shoes in the engaged position at high actuating torques.

Although it is also within the scope of the present invention to provide spring-biasing structures to bias the engagement shoes outwardly, such spring-biasing structures are likewise unduly complex and unnecessary in the present invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An expansible shaft assembly having a periphery for insertion into a roll core to exert torque on said core, said shaft assembly comprising:

(a) a shaft having an axis of rotation;

(b) a plurality of core-engagement shoes pivotally connected to said shaft so as to pivot about respective pivot axes extending parallel to said axis of rotation and spaced therefrom, said plurality of core-engagement shoes having outwardly-facing core-engaging surfaces pivotable about respective ones of said pivot axes; and (c) some of said core-engaging surfaces being pivotable about their respective pivot axes outwardly from said periphery in response to torque applied to said shaft assembly in one axial direction while others of said core-engaging surfaces are pivotable about their respective axes outwardly from said periphery in response to torque applied to said shaft assembly in the opposite axial direction.

2. The shaft assembly of claim 1 wherein said plurality of core-engagement shoes each has a pair of said core-engaging surfaces, one of said pair of core-engaging surfaces being pivotable outwardly from said periphery in response to torque applied to said shaft assembly in one axial direction, and the other of said pair of core-engaging surfaces being pivotable outwardly from said periphery in response to torque applied to said shaft assembly in the opposite axial direction.

3. The shaft assembly of claim 1 wherein said shaft comprises a tubular member surrounding said respective pivot axes and having a tubular wall defining separate apertures formed therein, said core-engaging surface of each of said shoes protruding outwardly through a respective one of said apertures.

4. The shaft assembly of claim 1 wherein at least a pair of said core-engagement shoes are spaced axially along said shaft, the respective core-engaging surface of one of said pair of core-engagement shoes being pivotable about its respective pivot axis outwardly from said periphery in response to torque applied to said shaft assembly in one axial direction, and the respective core-engaging surface of the other of said pair of core-engagement shoes being pivotable about its respective pivot axis outwardly from said periphery in response to torque applied to said shaft assembly in the opposite axial direction.

5. The shaft assembly of claim 1 including means for synchronizing the pivotal movements of said core-engagement shoes about their respective pivot axes.

6. The shaft assembly of claim 1 including respective groups of said core-engagement shoes, the respective core-engaging surfaces of one group being located at different distances from their respective pivot axes than the core-engaging surfaces of another group, further including detachment means for enabling interchangeable connection of said respective groups of engagement shoes pivotally to said shaft.

7. An expansible shaft assembly having a periphery for insertion into a roll core to exert torque on said core, said shaft assembly comprising:

(a) a shaft having an axis of rotation; and (b) a plurality of core-engagement shoes for pivotally connecting to said shaft so as to pivot about respective different pivot axes extending parallel to said axis of rotation and spaced therefrom, said plurality of core-engagement shoes having outwardly-facing core-engaging surfaces pivotable about respective ones of said pivot axes, each of said pivot axes being located along a respective one of multiple pivot-axis directions extending radially from said axis of rotation of said shaft;

(c) each respective core-engaging surface being pivotable about its respective axis outwardly from said periphery to engage said core in response to torque applied to said shaft, and pivotable about its respective pivot axis inwardly to disengage said core in response to the absence of said torque, each said core-engaging surface being positioned along a respective lever-arm direction extending from the respective pivot axis of the respective core-engagement shoe, each respective lever-arm direction having an outwardly-facing angular separation of at least 70° from the respective pivot-axis direction associated with said respective core-engagement shoe;

(d) wherein said core-engaging surface is one of a pair of core-engaging surfaces located on the same shoe on opposite sides of said respective pivot-axis direction.

8. An expansible shaft assembly having a periphery for insertion into a roll core to exert torque on said core, said shaft assembly comprising:

(a) a shaft having an axis of rotation; and (b) a plurality of core-engagement shoes for pivotally connecting to said shaft so as to pivot about respective different pivot axes extending parallel to said axis of rotation and spaced therefrom, said plurality of core-engagement shoes having outwardly-facing core-engaging surfaces pivotable about respective ones of said pivot axes, each of said pivot axes being located along a respective one of multiple pivot-axis directions extending radially from said axis of rotation of said shaft;

(c) each respective core-engaging surface being pivotable about its respective axis outwardly from said periphery to engage said core in response to torque applied to said shaft, and pivotable about its respective pivot axis inwardly to disengage said core in response to the absence of said torque, each said core-engaging surface being positioned along a respective lever-arm direction extending from the respective pivot axis of the respective core-engagement shoe, each respective lever-arm direction having an outwardly-facing angular separation of at least 70° from the respective pivot-axis direction associated with said respective core-engagement shoe;

(d) wherein at least a pair of said core-engagement shoes are spaced axially along said shaft, the respective core-engaging surface of one of said pair of core-engagement shoes being located on one side of its respective pivot-axis direction, and the respective core-engaging surface of the other of said pair of core-engagement shoes being located on the opposite side of its respective pivot-axis direction.

9. An expansible shaft assembly having a periphery for insertion into a roll core to exert torque on said core, said shaft assembly comprising:

(a) a shaft having an axis of rotation; and (b) a plurality of core-engagement shoes for pivotally connecting to said shaft so as to pivot about respective different pivot axes extending parallel to said axis of rotation and spaced therefrom, said plurality of core-engagement shoes having outwardly-facing core-engaging surfaces pivotable about respective ones of said pivot axes, each of said pivot axes being located along a respective one of multiple pivot-axis directions extending radially from said axis of rotation of said shaft;

(c) each respective core-engaging surface being pivotable about its respective axis outwardly from said periphery to engage said core in response to torque applied to said shaft, and pivotable about its respective pivot axis inwardly to disengage said core in response to the absence of said torque, each said core-engaging surface being positioned along a respective lever-arm direction extending from the respective pivot axis of the respective core-engagement shoe, each respective lever-arm direction having an outwardly-facing angular separation of at least 70° from the respective pivot-axis direction associated with said respective core-engagement shoe;

(d) said expansible shaft assembly including respective groups of said core-engagement shoes, the respective core-engaging surfaces of one group being located at different distances from their respective pivot axes than the core-engaging surfaces of another group, further including detachment means for enabling interchangeable connection of said respective groups of engagement shoes pivotally to said shaft.

10. An expansible shaft assembly having a periphery for insertion into a roll core to exert torque on said core, said shaft assembly comprising:

(a) a shaft having an axis of rotation;

(b) a plurality of core-engagement shoes pivotally connected to said shaft so as to pivot about respective pivot axes extending parallel to said axis of rotation and spaced therefrom, each of said pivot axes being located along a respective one of multiple pivot-axis directions extending radially from said axis of rotation of said shaft;

(c) said plurality of core-engagement shoes each having a pair of outwardly-facing core-engaging surfaces located on opposite sides of the respective pivot-axis direction associated with the respective core-engagement shoe.

11. The shaft assembly of claim 10 including means for synchronizing the pivotal movements of said core-engagement shoes about their respective pivot axes.

12. The shaft assembly of claim 10 including respective groups of said core-engagement shoes, the respective core-engaging surfaces of one group being located at different distances from their respective pivot axes than the core-engaging surfaces of another group, further including detachment means for enabling interchangeable connection of said respective groups of engagement shoes pivotally to said shaft.

13. An expansible shaft assembly having a periphery for insertion into a roll core to exert torque on said core, said shaft assembly comprising:

(a) a shaft having an axis of rotation;

(b) a plurality of core-engagement shoes pivotally connected to said shaft so as to pivot about respective pivot axes extending parallel to said axis of rotation and spaced therefrom, said plurality of core-engagement shoes having outwardly-facing core-engaging surfaces pivotable about respective ones of said pivot axes;

(c) said core-engagement shoes being arranged in respective different groups spaced axially along said shaft, the core-engaging surfaces of one of said groups being pivotable about their respective pivot axes outwardly from said periphery in response to torque applied to said shaft assembly in one axial direction, and the core-engaging surfaces of another of said groups being pivotable about their respective pivot axes outwardly from said periphery in response to torque applied to said shaft assembly in the opposite axial direction.

14. The shaft assembly of claim 13 including means for synchronizing the pivotal movements of the core-engagement shoes of a respective group about their respective pivot axes.

15. The shaft of claim 13 wherein said shaft comprises a tubular member surrounding said respective pivot axes in fixed relationship to said pivot axes and having a tubular wall defining separate apertures therein, each of said core-engaging surfaces protruding outwardly through a respective one of said apertures.

16. An expansible shaft assembly having a periphery for insertion into a roll core to exert torque on said core, said shaft assembly comprising:

(a) a shaft having an axis of rotation; and (b) a plurality of core-engagement shoes for pivotally connecting to said shaft so as to pivot about respective pivot axes extending parallel to said axis of rotation and spaced therefrom;

(c) each of said core-engagement shoes having an outwardly-facing core-engaging surface, said core-engagement shoes being arranged in respective different groups each having its respective core-engaging surfaces located at different distances from their respective pivot axes than the core-engaging surfaces of another of said groups; and (d) detachment means for enabling interchangeable connection of said respective different groups of core-engagement shoes pivotally to said shaft.

* * * * *